US005653078A

United States Patent [19]

Kies et al.

[11] Patent Number: 5,653,078

[45] Date of Patent: Aug. 5, 1997

[54] VARIABLE EMBEDMENT ANCHOR AND METHOD

[75] Inventors: Antonius M. Kies, Oisterwijk; Hendrikus Cornelis van den Nieuwelaar, Gilze, both of Netherlands

[73] Assignee: Erico International Corporation, Solon, Ohio

[21] Appl. No.: 536,274

[22] Filed: Sep. 29, 1995

[51] Int. Cl.[6] ..... E04B 1/38

[52] U.S. Cl. ..... 52/698; 52/699; 52/701; 52/704

[58] Field of Search ..... 52/698, 699, 701, 52/704

[56] References Cited

U.S. PATENT DOCUMENTS

| | | | |
|---|---|---|---|
| 3,216,157 | 11/1965 | Pinter | 52/699 X |
| 3,599,379 | 8/1971 | Tuska | 52/699 |
| 3,867,804 | 2/1975 | Wilson | 52/699 |
| 3,896,627 | 7/1975 | Brown | 52/698 X |
| 4,129,007 | 12/1978 | Rausch | 52/698 X |
| 4,198,798 | 4/1980 | Haydock | 52/699 |
| 4,238,987 | 12/1980 | Siebrecht-Reuter | 52/698 X |
| 4,623,170 | 11/1986 | Cornwall | 52/699 X |
| 4,706,437 | 11/1987 | Boecker, Jr. | 52/698 |
| 5,415,510 | 5/1995 | Funaki et al. | 52/699 X |
| 5,428,936 | 7/1995 | Roth | 52/704 |

OTHER PUBLICATIONS

Erico® Concrete Construction Products, "Lenton® Terminator™ for Rebar Anchorage".

*Primary Examiner*—Wynn E. Wood
*Attorney, Agent, or Firm*—Renner, Otto, Boisselle, Sklar

[57] ABSTRACT

In steel reinforced concrete structures, a hanging system uses an embeddment anchor with a head or washer positioned behind the second layer of reinforcing from the load being supported. An adjustable length tubular opening or shank extends from the head or washer to the form which forms the surface from which the load is to be supported. In the tubular embodiment, two sealed tube sections telescope with respect to each other for adjustment to the required distance and are held to the head or washer by a removable plastic threaded fastener. After the concrete is poured, the fastener is removed and a threaded stud such as a rod is threaded into the head or washer through the tube. The tube is then sealed. In another embodiment, an internally threaded sleeve is adjusted on a threaded shank to obtain the variable distance from the washer or head to the form.

31 Claims, 3 Drawing Sheets

VARIABLE EMBEDMENT ANCHOR AND METHOD

DISCLOSURE

This invention relates generally as indicated to a variable embeddment anchor and method, and more particularly to steel reinforced concrete structures and hanging or attaching systems using such anchors, and to a method of using and installing both the anchor and the system.

BACKGROUND OF THE INVENTION

It is known to embed anchors in steel reinforced concrete structures. For example, anchors may be embedded in precast sections for a variety of purposes, which range all of the way from hanging utilities such as piping, to hanging facade, or even lifting the precast section. In poured-in-place steel reinforced concrete structures, rods which are bent or hooked, and which may have a protruding threaded end are often employed. Some include an exposed threaded or grout socket. Some hanging systems form holes in the concrete and then drive or wedge in fasteners. Some grout or literally glue (epoxy) a fastener or bracket in the hole. Nails or other studs can be driven in concrete with enough impact.

Recent code changes have significantly increased the amount of steel reinforcing used in concrete structures, while designers are striving for thinner or more compact structural elements. The result is more steel reinforcing congestion and placement problems. This is one of the reasons that headed anchors are preferred since they eliminate the need for substantial lengths of bent or hooked reinforcing bar, thus minimizing steel congestion. Headed anchors are also less unwieldy, that is they are smaller and more compact and are easier to install at the site.

Most of the above fastening systems bear little, if any, compatible relationship to the steel reinforcing of the poured-in-place or precast concrete. While some may hook over a reinforcing bar or even be threaded to a bar end, the fasteners or anchors employed are not readily adaptable to concrete sections with spaced layers of steel reinforcing.

Where multiple layers or mats of reinforcing are provided, the enlarged head of any anchor for a hanger should literally be behind both layers. By "behind" is meant on the opposite side of the load. For example, if a heavy pipe is hung from a slab or deck, the head of the anchor should be above the uppermost layer of steel reinforcing. If a vertical exterior panel or cladding is hung from a steel reinforced concrete frame, the head of the anchor should be behind the innermost layer of steel reinforcing. In fact, some codes now require this placement of the anchor head. Complicating the matter further is that the head should also be spaced from the top of the slab or deck, or the interior of the frame. With such positioning, the shear cone for a round head (pyramid for a rectangular head) has an enlarged base on the surface from which the load is supported and the reinforcing extends through the cone or pyramid zone as shear connectors.

While some structures are sufficiently large that anchors or hangers may be customed designed for the project, the tolerances in steel reinforcing for large structures are such that even customed designed anchors seldom fit easily. In most structures, there will be substantial variation in dimensions, some of which is intended. For example, as a building rises, columns and other main frame elements usually get smaller. Spans and slab or deck thickness may vary. Even a custom anchor actually may have a number of size variations. Accordingly, it would be desirable to have an adjustable or dimension variable headed anchor which could properly be positioned with respect to the steel reinforcing and the structure surfaces, regardless of the thickness or dimension variations.

Another problem with anchors is corrosion. Anchors exposed to chloride intrusions or a corrosive environment will rust or corrode if not properly protected. A hanger, rod or other part of the hanging system outside the concrete structure can be inspected, coated, recoated and, if necessary, fairly inexpensively replaced. That, however, is not true for the part of the anchor or hanging system embedded in concrete.

The corrosion of steel in concrete causes the concrete to spall and crumble. Repair or replacement is an expensive undertaking. Accordingly, it would be desirable that the ultimate anchor head have minimal exposure to the environment and any part exposed be capable of being thoroughly coated or sealed.

SUMMARY OF THE INVENTION

A steel reinforced concrete structure includes an embeddment anchor for a hanging system. The anchor includes a head or washer positioned on the side of the steel reinforcement opposite the load with an adjustable support extending from the head or washer to the load side of the surface of the concrete structure.

More particularly, the structure includes multiple layers of steel reinforcement and the head or washer is positioned beyond at least the second layer from the load, yet spaced from the opposite surface of the structure. The head or washer is preferably rectangular or square in plan and in contact with the steel reinforcing.

In a preferred form, the head or washer includes a threaded opening in which a plastic cap screw is positioned. The cap screw holds one of two sealed and telescoping plastic tubular sections to the head or washer, the other tubular section extending to the form for the surface of the structure from which the load will be supported. A flange or tabs on the other tubular section enables it to be fastened to the inside of a form for that surface. The two sections are sealed to prevent water or concrete from entering the tube formed by the sections. In one form, the tubular sections include thread forms so that the overall length is adjusted by relative rotation. The head or washer may include a spherical or dished washer of similar plan and a top soft washer.

In operation after the pour and the removal of the form, the plastic cap screw is removed through the tube with a suitable tool, and a threaded rod is inserted in the head or washer. The entire tube may be filled with a sealant or the hanger rod may be properly coated. The lower or outer end of the tube may be closed and sealed by a rubber shoulder grommet permitting some lateral misalignment between the tube and rod.

In another form, a threaded stud extends from the head or washer receiving an elongated externally fluted internally threaded sleeve, one end of which abuts the form and forms an internally threaded exposed socket for a threaded hanger rod when the form is removed.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
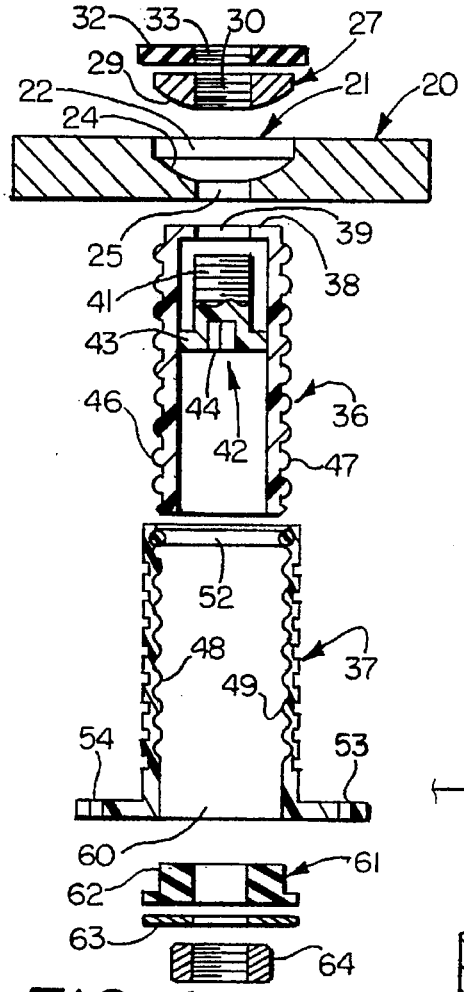
FIG. 1 is an exploded sectional view of an anchor assembly in accordance with the present invention.
Figure 4:
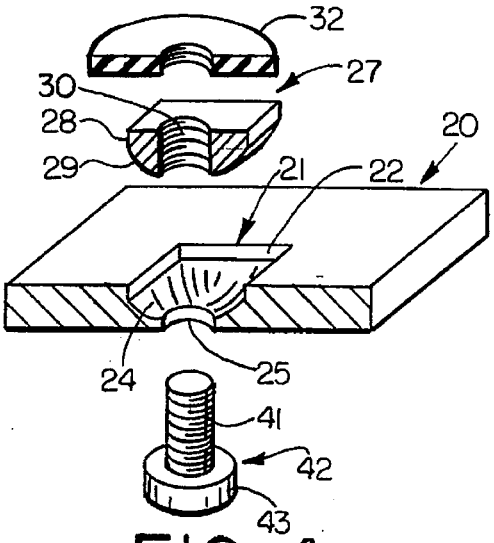
FIG. 4 is an isometric view of the anchor head or washer and the spherical nut therein.
Figure 2:
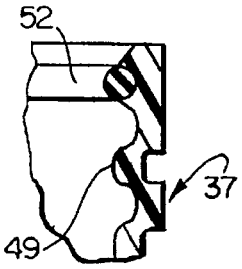
FIG. 2 is an enlarged fragmentary section of the seal for the two telescoping tubular sections.

Referring initially to FIGS. 1–5, there is illustrated one embodiment of the present invention. As seen in FIG. 1, the variable anchor includes a relatively large head 20 having a rectangular or square planar configuration. The head is provided with a central cavity indicated at 21 which includes an upper square portion 22 having the same configuration as the head 20, and a lower spherical portion 24, which extends to smaller clearance hole 25 in the bottom of the head. Fitting within the cavity 21 is a spherical washer 27. The washer 27 has a square top or upper rim 28 and a spherical bottom 29 which seats in the recess portion 24. The washer fits the cavity with some clearance which enables the washer to move so that the axis of threaded central opening 30 may vary slightly with respect to the major plane of the head 20. Immediately above the washer 27 is an enlarged soft washer 32 which may be made of rubber or other elastomer. The enlarged soft washer is provided with a central threaded opening 33. The washer is of sufficient diameter to cover and seal the square top of the recess 21 to keep concrete from intruding when the concrete is poured.

Below the head 20, there is provided plastic tubular sections 36 and 37. The upper section 36 is of a slightly smaller diameter than the lower section 37 and the upper section is designed to telescope within the lower section. The upper section is provided with an internal top flange seen at 38 which leaves a restricted hole 39 in the top of the tubular section 36. The hole 39 accommodates the shank 41 of plastic cap screw 42. The screw includes an enlarged head 43 having an hexagonal recess 44. When the shank of the plastic cap screw 42 is threaded into the spherical washer, through the hole 39, the tubular section 36 is secured to the underside of the head 20, as seen, for example, in FIG. 3.

The exterior of the smaller tubular section is provided with projecting thread projections seen at 46 and 47 which are designed to mesh with internal female thread projections 48 and 49 on the interior of the somewhat larger tubular section 37. The thread projections need not extend completely helically of the tubular sections, but only through a relatively short portion of the circumference, and such thread projections may have a relatively large pitch so that when the two tubular sections are in threaded engagement, the axial length of the assembly may be adjusted substantially with relatively slight rotation of the larger tubular section 37 with respect to the smaller section 36. The upper end of the tubular section 37 is provided with a relatively soft internal O-ring or seal seen at 52 which seals the interior of the telescoping tubular sections against fluid intrusion during the concrete pour.

Figure 3:
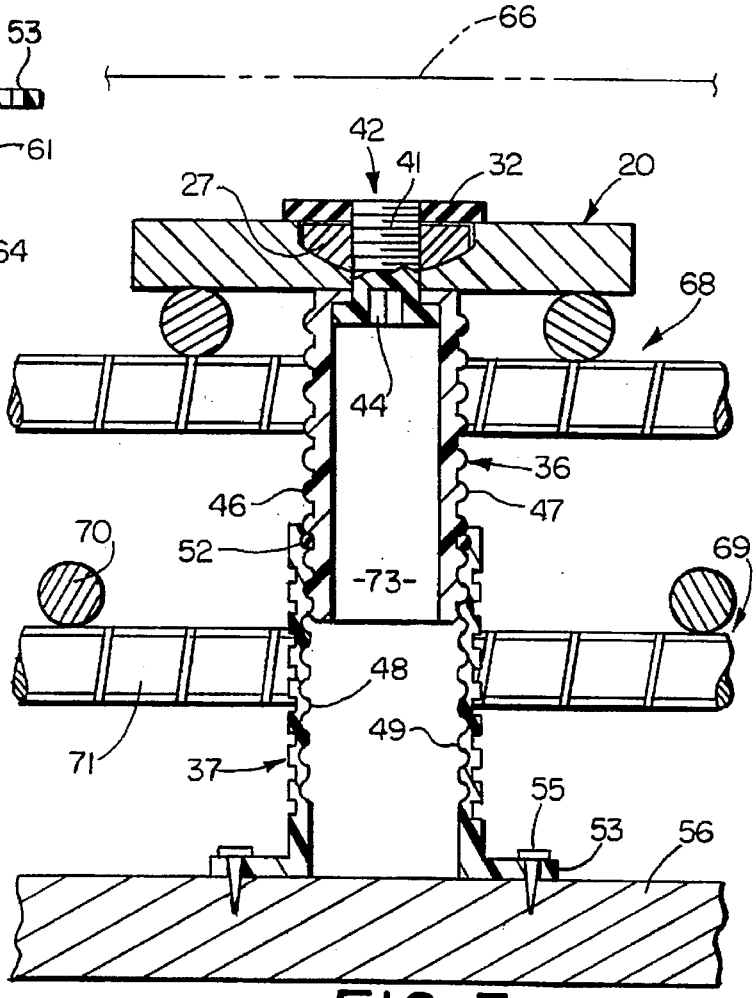
FIG. 3 is an assembled sectional view of the anchor installed in a form before the pour.

The bottom of the larger tubular section 37 is provided with radially projecting exterior flange or tabs seen at 53 which may be provided with fastener holes 54 so that fasteners 55 may secure the tubular section 37 to form 56 as seen in FIG. 3.

The lower tubular section 37 is provided with interior bottom opening seen at 60 which may be closed after the pour and form removal by a shoulder grommet 61 which has an exterior cylindrical surface 62 designed to fit within the opening 60 in a snug sealing fit. A relatively thin washer seen at 63, and a nut 64, may also be part of the assembly, although not employed until the anchor is installed.

Figure 5:
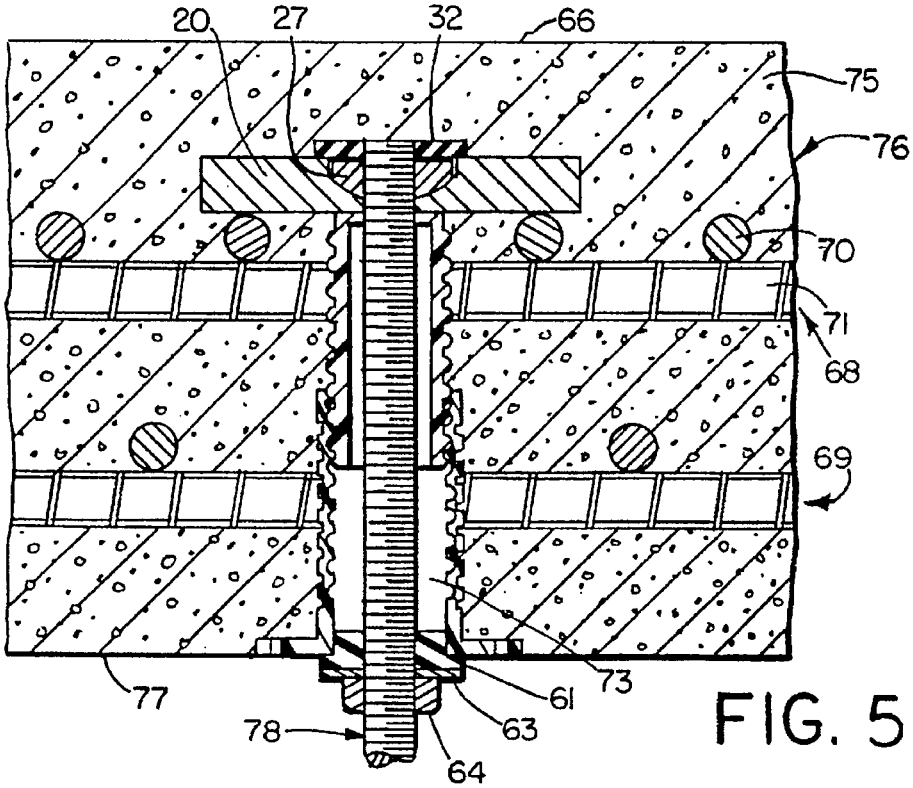
FIG. 5 is a view like FIG. 3, but after the pour and with a threaded hanger rod installed.

Referring now to FIG. 3, there is illustrated the installation of the anchor in the form with respect to the steel reinforcing before the pour, and in FIG. 5, the anchor embedded in the steel reinforced concrete after the pour and cure of the concrete. In FIG. 3, the form 56 forms the lower surface of a slab or deck and the phantom line 66 in FIG. 3 (solid in FIG. 5) will be the upper surface of the deck. In the deck or slab, there are two layers of reinforcing steel, generally indicated at 68 and 69. Each layer may constitute steel reinforcing bars 70 and 71 extending at right angles to each other in overlapping fashion. The anchor head 20, assembled with the telescoping tubular sections by the plastic cap screw 42, is positioned above the layer 68 with the tubular sections adjustably extended to form the hollow tubular interior shown at 73. The adjustably extended lower section 37 is fastened to the form 56.

Concrete indicated at 75 in FIG. 5 is then poured into the form to form the deck or slab seen at 75. The bottom surface of the slab is shown at 77 and is of course formed by the removed form 56.

When the form is removed and the concrete cured, access is then provided to the plastic cap screw through the tubular opening 73. The plastic cap screw may then be removed simply by unscrewing it with a suitable wrench fitting within the hexagonal socket. This then exposes the threads in the spherical washer 27. To complete the hanging system, a threaded rod indicated at 78 is inserted through the tubular opening 73 and threaded into the spherical washer 27 as illustrated. The lower end of the tubular opening 73 may then be closed and sealed with the shoulder grommet 61, pressed in place by the washer 63, and the nut 64, threaded on the threaded rod 78. The spherical washer accommodates any axial misalignment and the soft washer 32 ensures that the full height of the threads of the spherical washer and the threaded rod will be in engagement with each other when the threaded rod is properly seated as shown in FIG. 5.

As the rod is installed, it may be coated with a protective coating or the entire opening 73 may be filled with a sealant. In FIG. 5, the embedded anchor is complete and the head 20 is positioned on the opposite side of the layer of reinforcing 68 from the load. It is also noted that the head 20 is significantly spaced from the top of the slab or deck indicated at 66. It will be appreciated that if the reinforced concrete structure extends vertically such as a frame or wall, the anchor, nonetheless, would be positioned as though FIG. 5 were turned on its side. The anchor head, being square in plan, cannot rotate within the concrete and the hanger rod or other fastener for the hanging system may quickly be inserted into the spherical washer. Both the spherical washer 27 and the grommet 61 allow for some misalignment.

Figure 6:
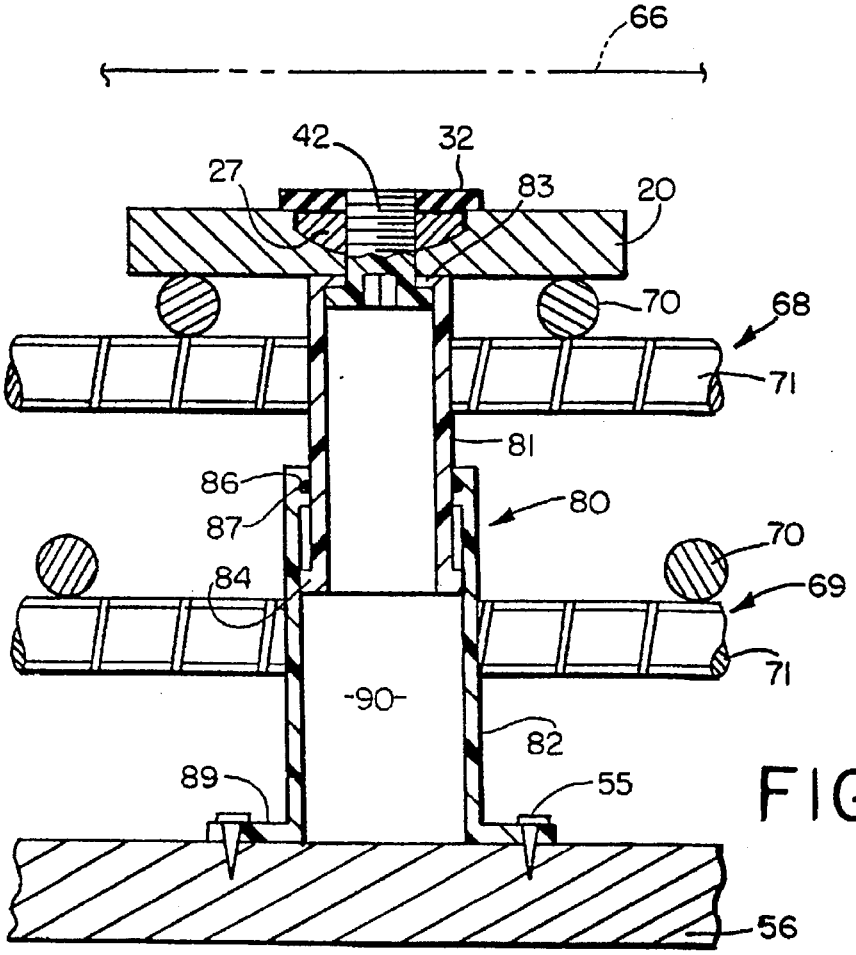
FIG. 6 is a view like FIG. 3 of another embodiment assembled before the pour.
Figure 7:
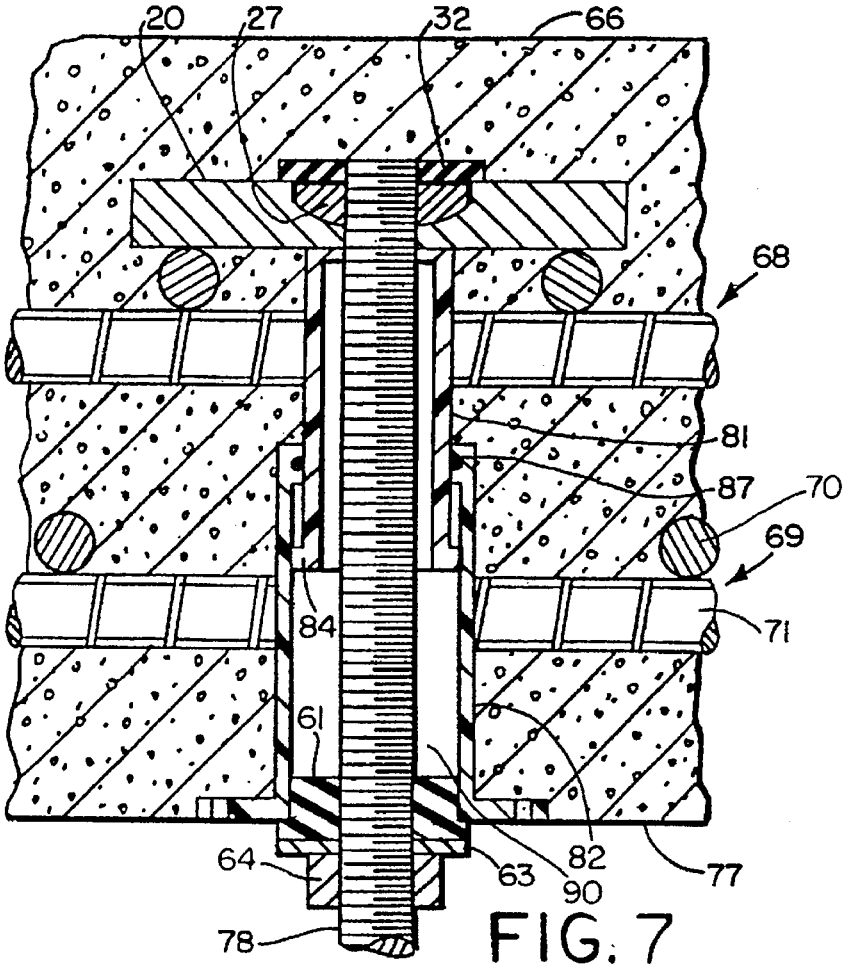
FIG. 7 is a view like FIG. 5 of the embodiment of FIG. 6 after the pour and with a threaded hanger rod installed.

Referring now to FIGS. 6 and 7, there is illustrated a slightly modified form of the present invention. Instead of adjusting the tubular length by relative rotation of the tube sections, the tube sections are unthreaded and are simply slid axially one with respect to the other. The telescoping tube shown generally at 80 includes a smaller diameter section 81 and a somewhat larger diameter section 82. The smaller upper section includes an internal flange 83 which is clasped to the head 20 by the head of the plastic cap screw 42. The lower end of the smaller tubular section 81 is provided with a radially outwardly extending stop shoulder 84. The upper end of the larger section 82 is provided with an annular groove 86 to receive sliding seal or O-ring 87. The sliding seal rides against the exterior of the smaller tubular section 81 and the seal housing engages the stop shoulder 84 to prevent disengagement of the telescoping tubular sections. The larger tubular section is provided at its outer end with a flange or tabs 89 by which the telescoping tube assembly may be secured to the form 56 by the fasteners 55. FIG. 7 illustrates the concrete deck poured and the form removed, with the hanger rod 78 inserted through the interior 90 of the telescoping tubes and threaded in the spherical washer of the head 20. The only difference between the two embodiments is that axial adjustment of the tubular length is obtained by simple sliding movement in FIGS. 6 and 7 and by relative rotation in FIGS. 1–5.

Figure 8:
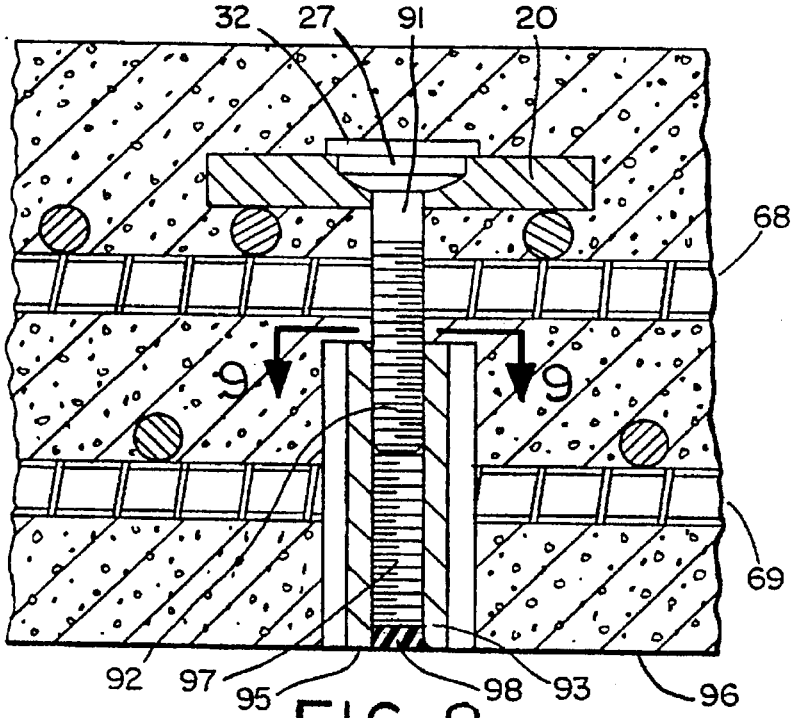
FIG. 8 is a view like FIG. 7 of yet another embodiment.
Figure 9:
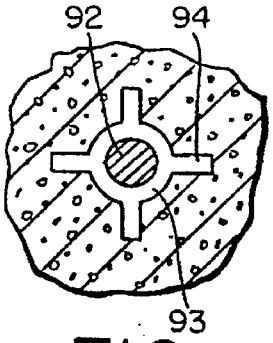
FIG. 9 is a horizontal section taken the line 9—9 of FIG. 8.

In FIGS. 8 and 9, there is illustrated yet another embodiment of the present invention. The head 20 is embedded in the concrete deck behind the second layer 68 of steel reinforcing and supports a high tension somewhat shorter threaded stud 91 through the spherical washer 27. If desired, the stud 91 may be in the form of a spherical head bolt. Whether threaded stud or threaded bolt, the downwardly projecting shank 92 is threadedly connected to internally threaded sleeve 93. The exterior of the sleeve is provided with radial fins or ridges 94. The lower end 95 of the sleeve is designed to abut the form which forms the lower surface 96 of the slab. The length of the sleeve permits the sleeve to be vertically adjusted along the threaded shank 92 so that the space between the head 20 and the surface 96 is adjustable or variable. When the form is removed and the concrete is cured, a threaded socket indicated at 97 is exposed to the surface for insertion of hangers such as threaded rod 78. If desired, the lower end of the socket 97 may be closed by a seal plug 98 to prevent concrete intrusion and to make clean threads available for the hanging system when the sealed plug is removed.

The plastic tubes of the present invention may readily be molded and if they include thread forms, they may be blow molded. One part of the plastic tube is connected to the threaded washer or head, and the other part of the plastic tube is secured to the form work. In this manner, the hanging system will comply with codes for the hanging of heavy loads by placing the anchor head on the opposite side of the second layer of reinforcing from the load. Accordingly, the anchor has a wide range of adjustment and can be adapted to various distances or thicknesses between the washer or head and the form work.

The anchor is easy to install since it can readily be adjusted and quickly secured to the interior of the form. No assembling or special tools are required other than the hex tool for removal of the plastic cap screw. One product covers a substantial range of distances. The anchor embedded within the steel reinforced concrete avoids exposure to the environment. The hanging system can readily be sealed or treated to avoid and minimize corrosion problems.

Although the invention has been shown and described with respect to certain preferred embodiments, it is obvious that equivalent alterations and modifications will occur to others skilled in the art upon the reading and understanding of this specification. The present invention includes all such equivalent alterations and modifications, .and is limited only by the scope of the claims.

What is claimed is:

1. In combination, a steel reinforced poured concrete structure having a surface and a layer of steel reinforcement having a side opposite said surface including an embedded in concrete anchor for supporting loads from said surface of the structure, said anchor including an anchor head positioned on said opposite side of said steel reinforcement layer, and adjustable support means extending from said anchor head through said layer of steel reinforcement to said surface for load accessing said anchor head when said structure is poured.

2. The combination set forth in claim 1 wherein said adjustable support means is a tube.

3. The combination set forth in claim 1 wherein said adjustable support means includes a threaded stud.

4. The combination set forth in claim 3 wherein said adjustable support includes a threaded socket exposed at said surface.

5. The combination set forth in claim 4 including means to seal said threaded socket when the concrete structure is poured.

6. The combination set forth in claim 1 wherein said adjustable support means is an adjustable length tube providing access to the anchor head after the concrete structure is poured.

7. The combination set forth in claim 1 wherein said structure includes a second surface, said head being spaced internally from said second surface.

8. The combination set forth in claim 1 wherein said anchor head has a rectilinear exterior whereby it cannot rotate with respect to the concrete.

9. The combination set forth in claim 1 including a second layer of steel reinforcement in said structure, said second layer having a side opposite said surface, said anchor head being positioned on the opposite side of said second layer from said surface.

10. The combination set forth in claim 1 including a threaded washer in said anchor head, and a sealed adjustable-in-length tube extending from said socket to said surface when the structure is poured.

11. The combination set forth in claim 10 including a plastic cap screw in said threaded socket operative to seal said socket when the concrete is poured.

12. The combination set forth in claim 11 wherein said plastic cap screw has a cap on one end to secure said tube to said head, while the other end of said screw projects slightly beyond the other side of said head.

13. The combination set forth in claim 12 including a recessed drive socket in said screw cap to enable said screw to be removed through said tube and expose all of the socket threads of said head for threaded insertion of a hanger.

14. The combination set forth in claim 10 wherein said tube comprises two sections, one telescoping in the other.

15. The combination set forth in claim 14 wherein said two tube sections are molded plastic.

16. The combination set forth in claim 15 including threads formed in the tube section walls meshing with each other whereby the tube may be adjusted in length by relative rotation of the sections.

17. The combination set forth in claim 15 wherein said tube sections are sealed to each other.

18. The combination set forth in claim 10 including a hanger extending through said tube and threaded into said anchor head.

19. The combination set forth in claim 18 including a corrosion resistant seal for the interior of said tube surrounding said hanger.

20. The combination set forth in claim 19 wherein said hanger comprises a threaded rod, and a sealing grommet on said threaded rod closing and sealing said tube.

21. The combination set forth in claim 10 wherein the tube at the surface has a radial flange or tabs to enable the tube to be fastened to a form for forming said surface.

22. A method of installing a hanging system for a load in steel reinforced concrete structures having a surface formed by a form, and a first and second layer of steel reinforcing, comprising the steps of placing an anchor head behind at least the second layer of steel reinforcing and supporting the head adjustably from said form forming said surface from which said load is to be hung, and hanging a load from the said head after the concrete is poured and cured.

23. A method as set forth in claim 22 wherein an adjustable length tube obtains such adjustment and said load is hung directly from said head through said tube when the concrete is poured and cured.

24. A method as set forth in claim 23 wherein said tube is adjusted in length by relative rotation of separate sections.

25. A method as set forth in claim 23 wherein said tube is adjusted in length by axial telescoping of separate sections.

26. A method as set forth in claim 23 including sealing said tube when said load is hung.

27. A method as set forth in claim 23 including the step of joining said head and tube with a removable threaded fastener fitting in a threaded hole in said head, and removing said fastener after said concrete is poured and cured, and using said threaded hole to receive said hanging system.

28. A method as set forth in claim 27 including inserting a threaded rod in said threaded hole extending through said tube.

29. A method as set forth in claim 28 including the step of sealing the rod in the tube.

30. A method as set forth in claim 22 including the step of obtaining such adjustment with a threaded stud secured to said head and an internally threaded sleeve threaded on said stud, said internally threaded sleeve forming a socket exposed at said surface to receive the hanging system.

31. A method as set forth in claim 30 including the step of locking the sleeve against rotation once the concrete is poured and cured.

* * * * *